US005194777A

United States Patent [19]

Nakaya et al.

[11] Patent Number: 5,194,777

[45] Date of Patent: Mar. 16, 1993

[54] METHOD FOR FABRICATING ELECTROLUMINESCENCE DISPLAY DEVICE AND ELECTROLUMINESCENCE DISPLAY DEVICE

[75] Inventors: Hiroaki Nakaya; Takuo Yamashita; Takashi Ogura; Masaru Yoshida, all of Nara, Japan

[73] Assignee: Sharp Kabushiki Kaisha, Osaka, Japan

[21] Appl. No.: 466,649

[22] Filed: Jan. 17, 1990

[30] Foreign Application Priority Data

Jan. 18, 1989 [JP] Japan ..... 1-10732

[51] Int. Cl.[5] ..... H05B 33/22; B05D 5/06

[52] U.S. Cl. ..... 313/509; 427/66; 427/70

[58] Field of Search ..... 313/509; 427/66, 70

[56] References Cited

U.S. PATENT DOCUMENTS 4,686,110 8/1987 Endo et al. ..... 313/509 X
4,721,631 1/1988 Endo et al. ..... 313/509 X
4,880,661 11/1989 Endo et al. ..... 427/66 X
4,897,319 1/1990 Sun ..... 427/66 X

FOREIGN PATENT DOCUMENTS 63-29398 6/1988 Japan .
2-7387 1/1990 Japan .

*Primary Examiner*—Palmer C. DeMeo
*Attorney, Agent, or Firm*—Birch, Stewart, Kolasch & Birch

[57] ABSTRACT

A method for fabricating an electroluminescence display device is disclosed. The fabricating method includes steps of forming at least one transparent front electrode on a transparent substrate, forming a lower electrically insulating layer on the front electrode, forming an emitting layer of an electroluminescent material on the lower electrically insulating layer, forming an upper electrically insulating layer on the emitting layer, and forming at least one rear electrode on the upper electrically insulating layer. In the fabricating method, at least one of the lower and upper electrically insulating layers is composed of at least one film of $Si_xN_yO_z$:H, and the $si_xN_yO_z$:H film is formed by the plasma chemical vapor deposition method.

11 Claims, 6 Drawing Sheets

METHOD FOR FABRICATING ELECTROLUMINESCENCE DISPLAY DEVICE AND ELECTROLUMINESCENCE DISPLAY DEVICE

BACKGROUND OF THE INVENTION

1. Field of the Invention

The present invention relates to a method for fabricating an electroluminescence display device (referred to as an EL display device hereinafter) and an EL display device, and more particularly, to a method for fabricating an alternating-current drive and thin film type EL display device and an alternating-current drive and thin film type EL display device.

2. Description of Related Art

FIG. 1 is a schematic cross sectional view showing a structure of a conventional thin film type EL display device.

Referring to FIG. 1, the conventional thin film type EL display device comprises plural transparent ITO front electrodes 2 having a strip shape, a lower electrically insulating layer 10 composed of an $SiO_2$ film 3 and an SiN film 4, an emitting layer 5 of ZnS:Mn, an upper electrically insulating layer 20 composed of an SiN film 6 and an $Al_2O_3$ film 7, and plural Al rear electrodes 8 having a strip shape perpendicular to the transparent front electrodes 2, which are formed sequentially so as to be stacked on a transparent glass substrate 1. It is to be noted that the emitting layer 5 is sealed by the upper insulating layer 20.

However, the lower and upper insulating layers 10 and 20 are formed by the sputtering method at relatively low film formation speeds, and particularly, the film formation speed of the $Al_2O_3$ film 7 is the lowest among them, resulting in a low productivity.

SUMMARY OF THE INVENTION

An essential object of the present invention is to provide a method which makes fabricating time of an EL display device shorter than that of the conventional method.

Another object of the present invention is to provide an EL display device whose characteristics almost never deteriorate upon aging the EL display device.

In order to accomplish the above objects, according to one aspect of the present invention, there is provided a method for fabricating an electroluminescence display device including steps of:

forming at least one transparent front electrode on a transparent substrate:

forming a lower electrically insulating layer on the front electrode;

forming an emitting layer of an electroluminescent material on the lower electrically insulating layer;

forming an upper electrically insulating layer on the emitting layer; and forming at least one rear electrode on the upper electrically insulating layer;

the method being characterized in that at least one of the lower and upper electrically insulating layers is composed of at least one film of $Si_xN_yO_z$:H, and the $Si_xN_yO_z$:H film is formed by a plasma chemical vapor deposition method.

According to another aspect of the present invention, there is provided an electroluminescence display device comprising:

at least one transparent front electrode;

a lower electrically insulating layer;

an emitting layer of an electroluminescent material;

an upper electrically insulating layer; and at least one rear electrode which is formed so as to be stacked on a transparent substrate;

the device being characterized in that at least one of the lower and upper electrically insulating layers is composed of at least one film of $Si_xN_yO_z$:H which is formed by the plasma chemical vapor deposition method so that the composition ratio z/y of O to N falls within the range from 0.3 to 1.0, and the composition ratio x/y of Si to N falls within the range from 0.7 to 1.5.

BRIEF DESCRIPTION OF THE DRAWINGS

These and other objects and features of the present invention will become clear from the following description taken in conjunction with the preferred embodiment thereof with reference to the accompanying drawings, in which.

DETAILED DESCRIPTION OF THE PREFERRED EMBODIMENT

A preferred embodiment according to the present invention will be described in detail below with reference to the attached drawings.

Figure 1:
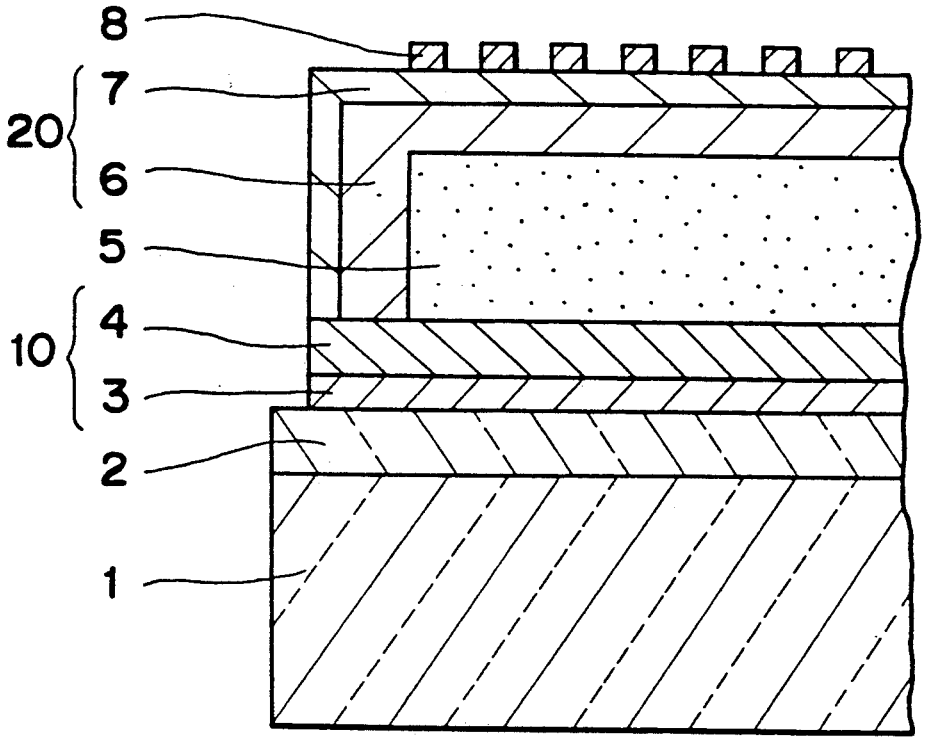
Fig. 1 PRIOR ART
FIG. 1 is a schematic cross sectional view showing a conventional thin film type EL display device.
Figure 2:
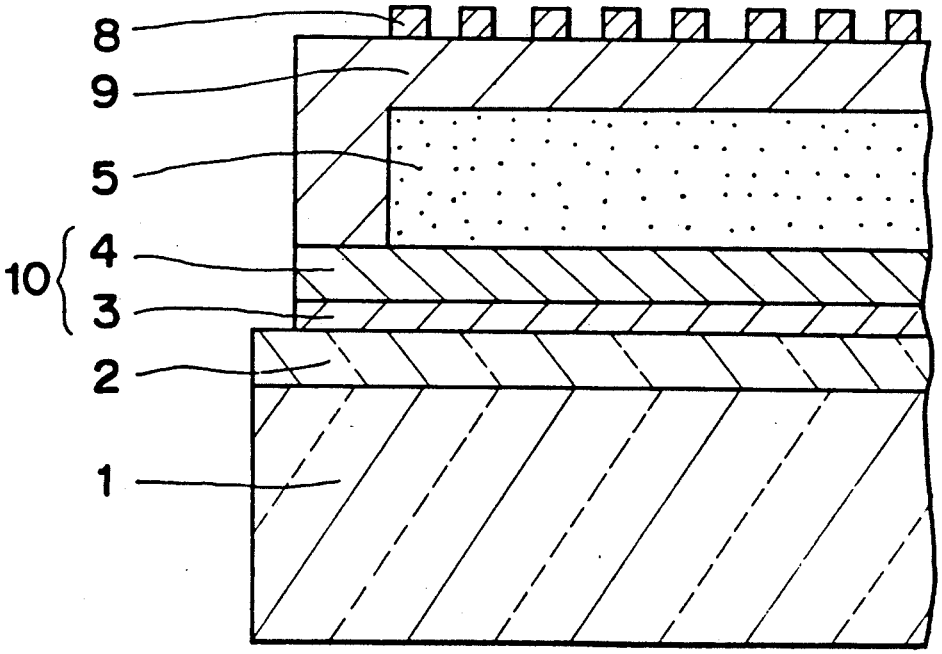
FIG. 2 is a schematic cross sectional view showing a thin film type EL display device of a preferred embodiment according to the present invention.

FIG. 2 is a schematic cross sectional view showing a structure of an alternating-current drive and thin film type EL display device of a preferred embodiment according to the present invention. In FIG. 2, the components similar to that shown in FIG. 1 are denoted by the same numerical references shown in FIG. 1.

Referring to FIG. 2, the thin film type EL display device comprises plural transparent ITO front electrodes 2 having a strip shape, a lower electrically insulating layer 10 composed of an $SiO_2$ film 3 having a thickness of about 400 Å and an SiN film 4 having a thickness in the range from about 1800 Å to about 2000

Å, an emitting layer 5 of an electroluminescent material such as ZnS:Mn, an upper electrically insulating $Si_xN_yO_z$:H layer 9 of one film having a thickness of about 1500 Å for sealing the emitting layer 5, and plural Al rear electrodes 8 having a strip shape perpendicular to the transparent front electrodes 2, which are formed sequentially so as to be stacked on a transparent glass substrate 1 under the condition of a temperature lower than about 700° C. It is to be noted that the lower electrically insulating layer 10 is formed on the transparent front electrodes 2 by the sputtering method, and the upper electrically insulating layer 9 is formed on the emitting layer 5 by the plasma chemical vapor deposition method (referred to as the plasma CVD method hereinafter) well known to those skilled in the art.

In the thin film type EL display device as fabricated above, when an alternating-current voltage is applied between the front and rear electrodes 2 and 8, each pixel of the emitting layer 5 to which the alternating-current voltage is applied emits wherein each pixel is positioned at each crossing between the front and rear electrodes 2 and 8.

Since the upper electrically insulating layer 9 is formed by the plasma CVD method at a film formation speed higher than that at which the conventional higher electrically insulating layer 20 is formed by the sputtering method, it can be formed in a shorter time than that of the conventional upper electrically insulating layer 20, resulting in a high productivity upon manufacturing the thin film type EL display device.

The composition ratio of the upper electrically insulating $Si_xN_yO_z$:H layer 9 is determined by respective partial pressures and/or respective flow rates of $N_2$ gas, $N_2O$ gas and $SiH_4$ gas which are materials thereof. Namely, the composition ratio z/y of O to N is determined by a partial pressure ratio Rp defined by the following equation (1), and the composition ratio x/y of Si to N is determined by a flow rate ratio Rf defined by the following equation (2):

$$Rp = \frac{N_2O \text{ gas pressure in } N_2 - N_2O \text{ mixed gas}}{\text{Total pressure of } N_2 - N_2O \text{ mixed gas}} \times 100\ [\%], \quad (1)$$

wherein the $N_2$—$N_2O$ mixed gas is composed of $N_2$ gas and $N_2$ O gas, and $$Rf = (\text{Flow rate of } SiH_4 \text{ gas})/Ft \times 100\ [\%], \quad (2)$$

wherein Ft is a total flow rate of the $SiH_4$ gas and the $N_2$-$N_2O$ mixed gas.

In order to determine an optimum composition ratio of the upper electrically insulating $Si_xN_yO_z$:H layer 9 for the thin film type EL display device, the present inventors performed the following experiments.

First of all, there were formed plural thin film type EL display devices comprising the upper electrically insulating layer 9 having different composition ratios by changing the partial pressure of $N_2O$ gas in the $N_2$-$N_2O$ mixed gas under the condition of a constant flow rate ratio Rf of 2.0%.

Figure 3:
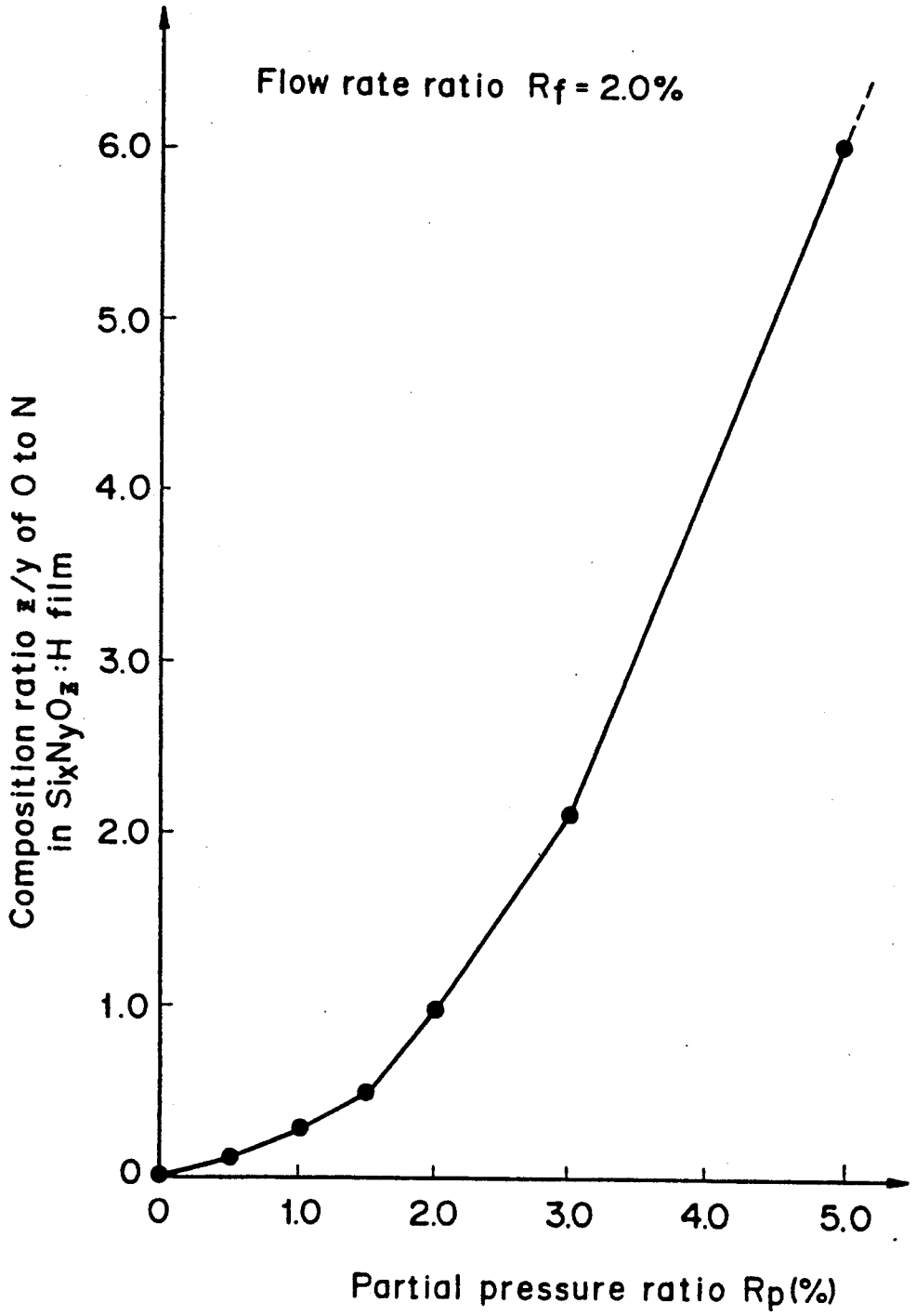
FIG. 3 is a graph showing a relationship between the composition ratio z/y of O to N in an upper electrically insulating $Si_xN_yO_z$:H layer of the EL display device shown in FIG. 2 and a partial pressure ratio Rp [%] defined as a ratio of an $N_2O$ gas pressure to a total pressure of an $N_2$—$N_2O$ mixed gas upon forming the upper electrically insulating layer.
Figure 4:
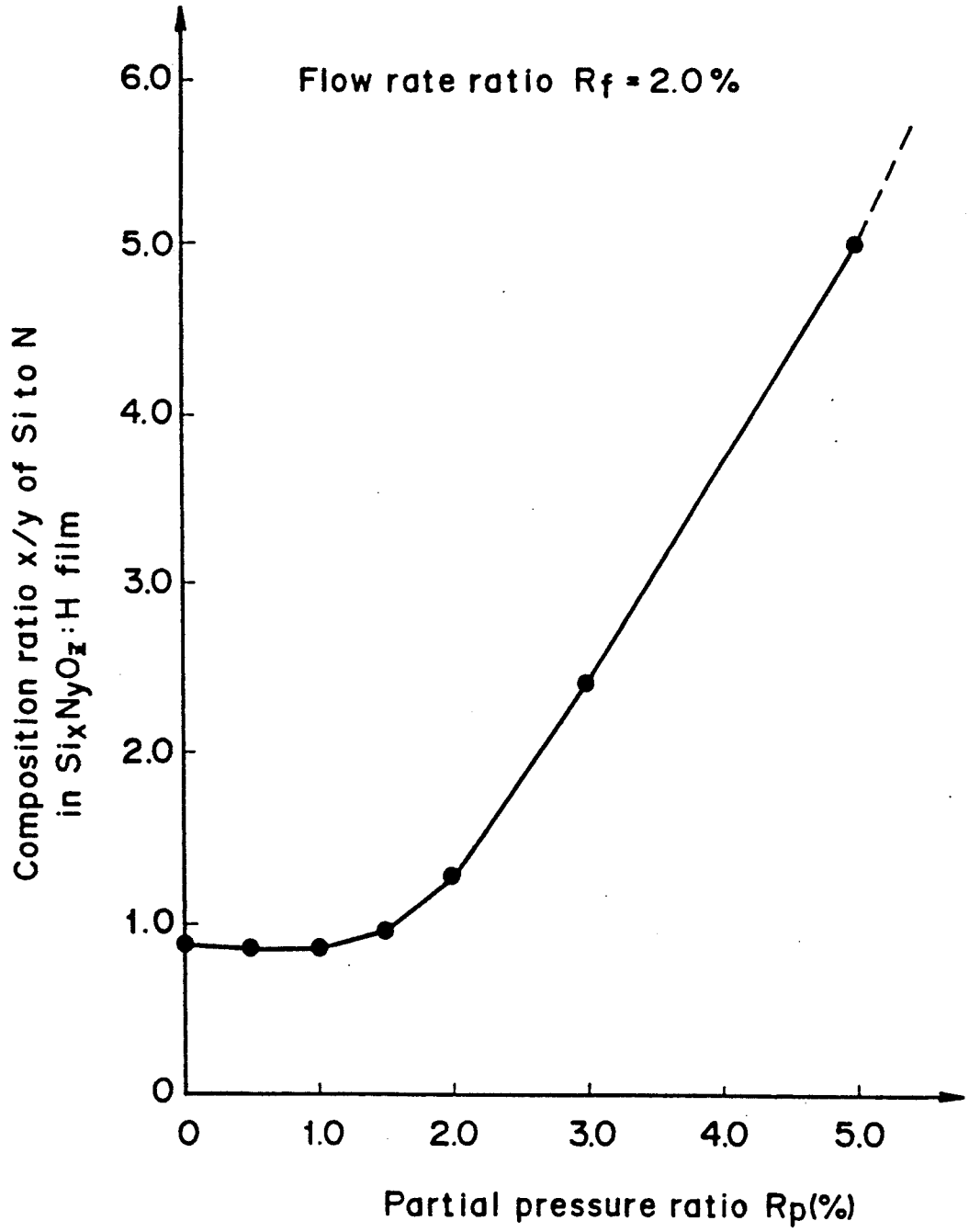
FIG. 4 is a graph showing a relationship between the composition ratio x/y of Si to N in the upper electrically insulating $Si_xN_yO_z$:H layer of the EL display device shown in FIG. 2 and the partial pressure ratio Rp [%]

FIGS. 3 and 4 show a relationship between the composition ratio z/y of O to N in the upper electrically insulating layer 9 and the partial pressure ratio Rp [%], and a relationship between the composition ratio x/y of Si to N in the upper electrically insulating layer 9 and the partial pressure ratio Rp [%], respectively, under the condition of a flow rate ratio Rf of 2.0%, which are obtained by the measurements performed by the Auger electron spectroscopy method.

Referring to FIG. 3, the composition ratio z/y increases monotonously in the range of the partial pressure ratio Rp from zero to 5.0%. On the other hand, referring to FIG. 4, the composition ratio x/y is kept approximately constant in the range of the partial pressure ratio Rp from zero to 1.5%, and increases monotonously in the range of the partial pressure ratio Rp from 1.5% to 5.0%.

It was discovered that the dielectric breakdown mode caused upon driving the thin film type EL display device was transferred from the propagation mode to the self-healing mode as the oxygen content in the upper electrically insulating layer 9 increased, and the dielectric breakdown mode became the self-healing mode at the composition ratios z/y equal to or larger than 0.3.

Figure 5:
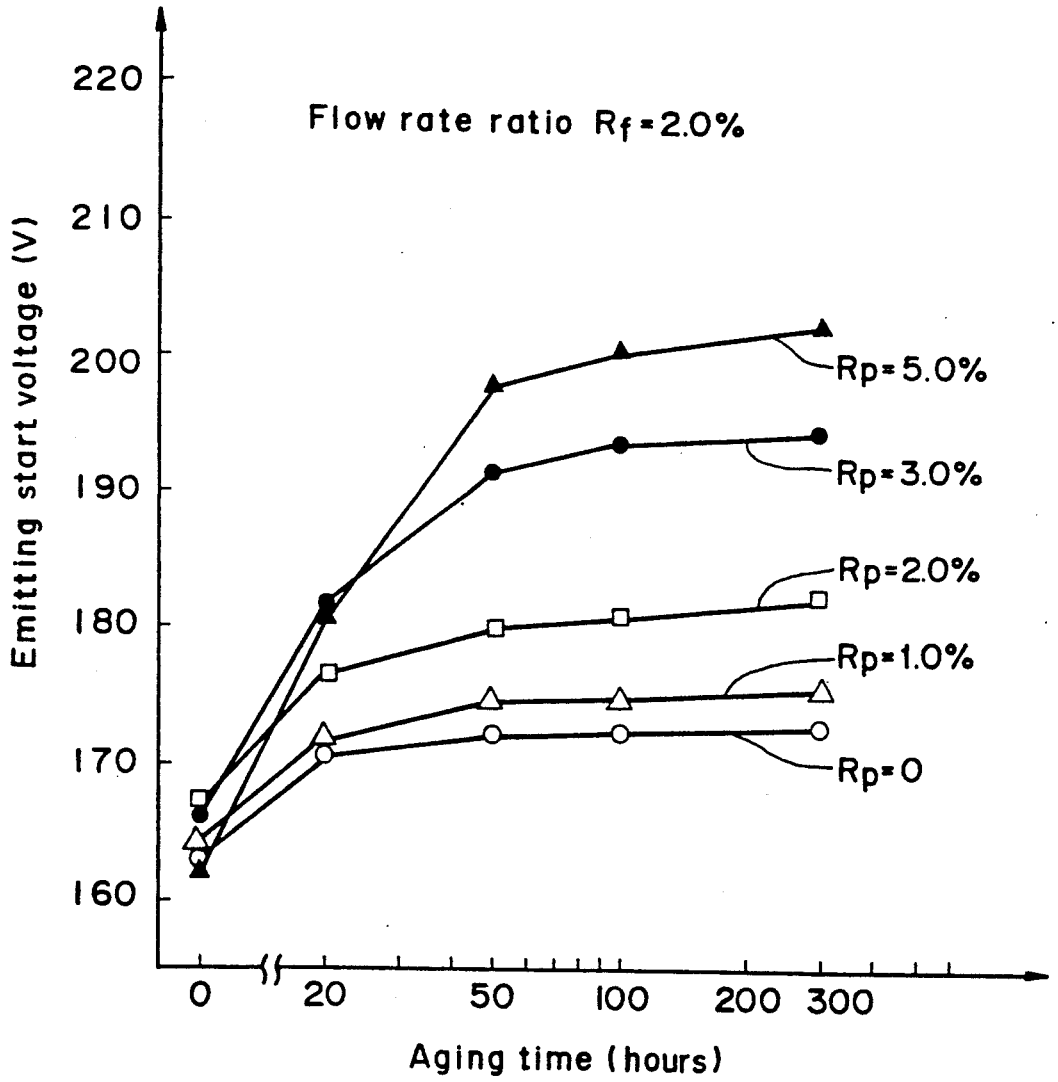
FIG. 5 is a graph showing a relationship between an emitting start voltage [V] and an aging time [hours] of the EL display device shown in FIG. 2.

FIG. 5 shows a relationship between an emitting start voltage [V] and an aging time [hours] under the condition of a flow rate ratio Rf of 2.0 %, wherein the above emitting start voltage is defined as a voltage to be applied to the thin film type EL display device at which it begins emitting.

As is apparent from FIG. 5, it was discovered that a change in the emitting start voltage [V]increased at an aging test of the thin film type EL display devices for an aging time longer than about 50 hours, as the partial pressure ratio Rp increased, namely, the oxygen content in the upper electrically insulating film 9 increased by increasing the partial pressure of $N_2O$ gas in the $N_2$-$N_2O$ mixed gas. In order to suppress the change in the emitting start voltage upon aging the El display device so as to keep the change amount therein equal to or lower than about 10% which is an allowable level in practical use, the above-defined partial pressure ratio Rp is preferably equal to or smaller than 2.0%. Namely, as is apparent from FIG. 3, the composition ratio z/y is preferably equal to or less than 1.0.

Figure 6:
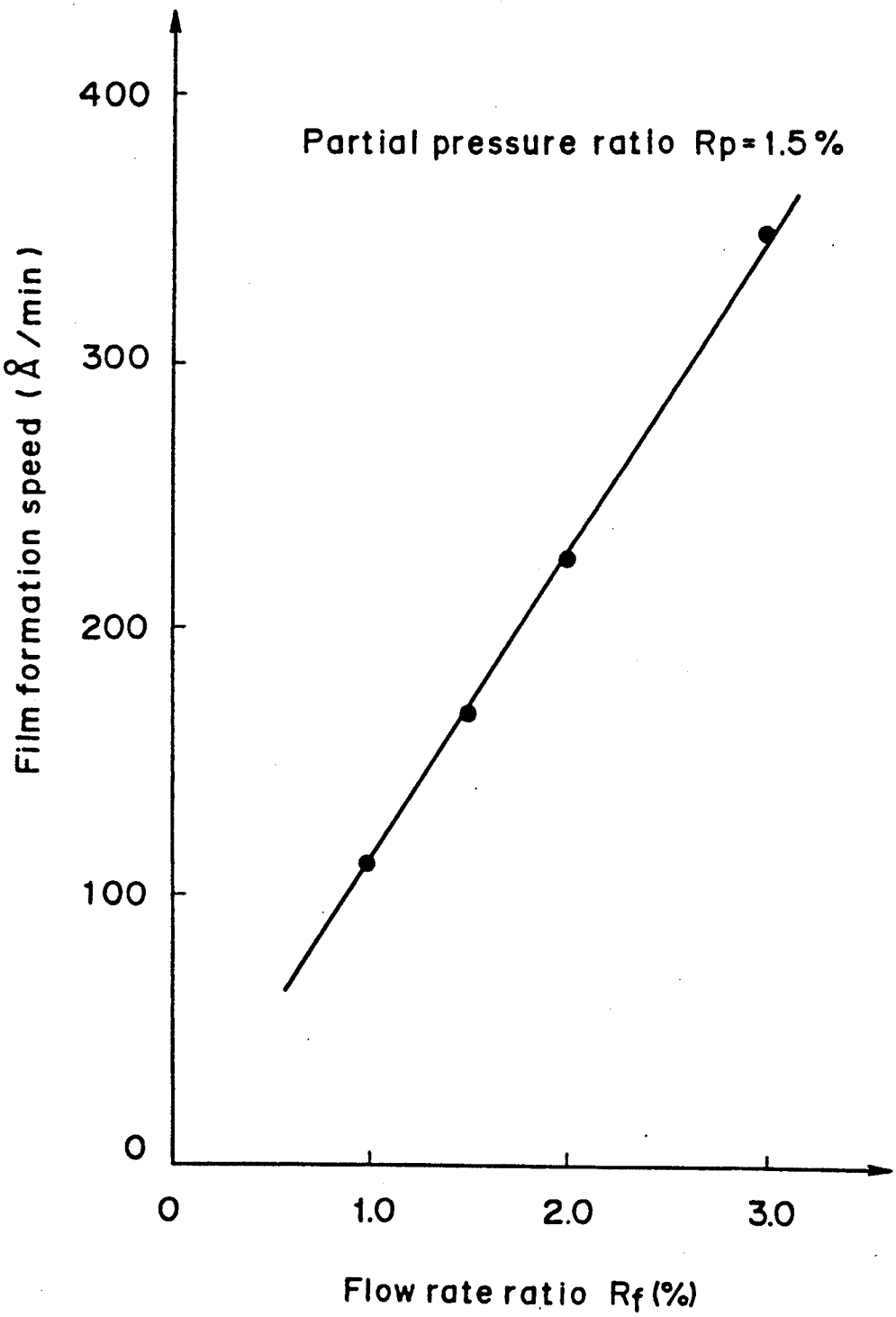
FIG. 6 is a graph showing a relationship between a film formation speed [Å/min.] at which the upper electrically insulating layer of the EL display device shown in FIG. 2 is formed and a flow rate ratio Rf [%]defined as a ratio of a flow rate of $SiH_4$ gas to a total flow rate of the $SiH_4$ gas and the $N_2$-$N_2O$ mixed gas upon forming the upper electrically insulating layer.

Next, the upper electrically insulating $Si_xN_yO_z$:H layer 9 was formed by the plasma CVD method at different flow rate ratios Rf under the condition of a constant partial pressure ratio Rp of 1.5%. FIG. 6 shows a relationship between the film formation speed [Å/min.] at which the upper electrically insulating layer 9 is formed and the flow rate ratio Rf [%]under the condition of a partial pressure ratio Rp of 1.5%, which is obtained by this experiment performed by the present inventors.

Referring to FIG. 6, the film formation speed increases in an approximately proportional manner to the flow rate ratio Rf, in the range of the flow rate ratio Rf from 1.0% to 3.0%.

Figure 7:
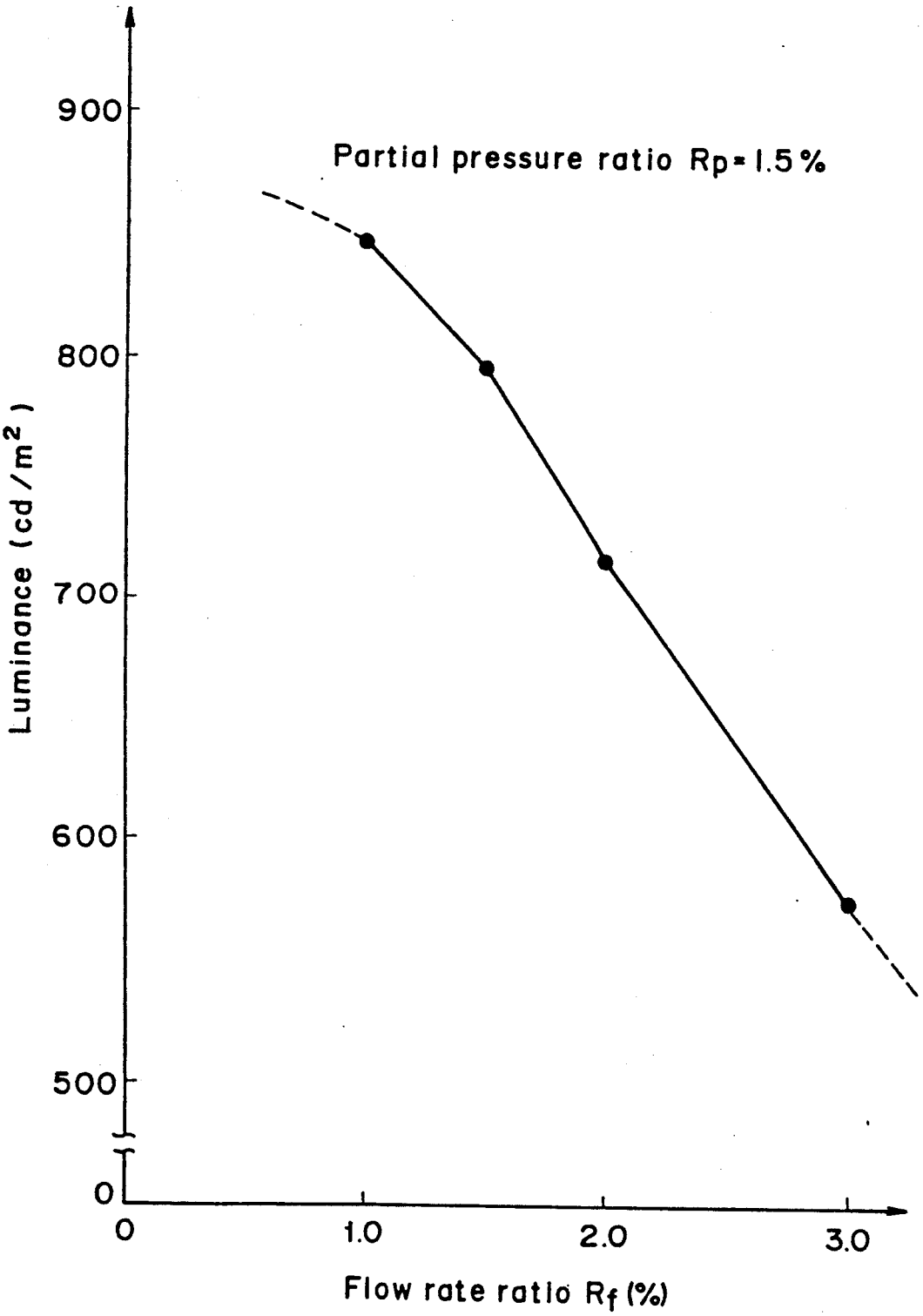
FIG. 7 is a graph showing a relationship between a luminance of the EL display device shown in FIG. 2 and the flow rate ratio Rf [%].

FIG. 7 shows a relationship between the flow rate ratio Rf and the luminance [cd/m$^2$] under the condition of a partial pressure ratio Rp of 1.5%, which is measured for various kinds of thin film type EL display devices comprising the upper electrically insulating $Si_xN_yO_z$:H layer 9 formed as described above.

Referring to FIG. 7, the luminance thereof decreases monotonously in the range of the flow rate ratio Rf from 1.0% to 3.0%. The flow rate ratio Rf is most preferably 2.0%, in order to obtain the thin film type EL display device comprising the upper electrically insulating layer 9 formed at a film formation speed higher than that of the conventional upper electrically insulating layer 20, which is capable of emitting at a luminance larger than an allowable level in practical use.

Furthermore, the present inventors measured respective hydrogen contents in the upper electrically insulating $Si_xN_yO_z$:H films 9 which had been formed as described above, using an infrared absorption spectrometer. The measured hydrogen contents falls within the range from $1\times10^{21}$ atoms/cm$^3$ to $2\times10^{22}$ atoms/cm$^3$.

As a comparative example, the present inventors formed the upper electrically insulating $Si_xN_yO_z$:H layer 9 using $NH_3$ gas in place of $N_2$ gas. At that time, respective hydrogen contents in these upper electrically insulating layers 9 were larger than $3\times10^{22}$ atoms/cm$^3$, and in the thin film type EL display device comprising the upper electrically insulating layer 9 of the comparative example, there was a problem that bubbles of $H_2$ gas were generated upon driving the thin film type EL display device thereof. On the other hand, since the thin film type EL display device of the preferred embodiment according to the present invention comprises the upper electrically insulating layer 9 having a relatively small hydrogen content equal to or smaller than $2\times10^{22}$ atoms/cm$^3$, the $H_2$ gas bubbles are eliminated.

According to the preferred embodiment of the present invention, there is fabricated a thin film type EL display device comprising a upper electrically insulating $Si_xN_yO_z$:H layer 9 which is formed by the plasma CVD method so that the composition ratio z/y of O to N falls within the range from 0.3 to 1.0, the composition ratio x/y of Si to N falls within the range from 0.7 to 1.5, and the hydrogen content is smaller than $2\times10^{22}$ atoms/cm$^3$. In the thin film type EL display device thereof, the dielectric breakdown mode is the self-healing mode, and the characteristics thereof are stable upon aging. Furthermore, the thin film type EL display device has a higher luminance which is capable of being put into practical use, and $H_2$ gas bubbles are prevented.

In the above-mentioned preferred embodiment, the thin film type El display device comprises the upper electrically insulating layer 9 of one film, however, the present invention is not limited to this. The upper electrically insulating layer 9 may be composed of electrically insulating $Si_xN_yO_z$:H films having different composition ratios which are formed so as to be stacked. In this structure of the upper electrically insulating layer 9, the composition ratio z/y of the electrically insulating film positioned on the side of the emitting layer 5 is preferably smaller than that of the electrically insulating film positioned on the side of the rear electrodes 8, namely, the composition ratio z/y of the electrically insulating film positioned on the side of the emitting layer 5 is preferably smaller than one, and that of the electrically insulating film positioned on the side of the rear electrodes 8 is preferably larger than one. Then, the thin film type EL display device can be obtained without deteriorating the characteristics thereof. At that time, the composition ratio z/y is allowed to be in the range from zero to 3.0, and the composition ratio is allowed to be in the range from 0.7 to 3.0.

In the above-mentioned preferred embodiment, the lower electrically insulating layer 10 is formed by the sputtering method, however, the present invention is not limited to this. The lower electrically insulating layer 10 may be formed by the plasma CVD method.

Furthermore, the lower electrically insulating layer 10 may be composed of electrically insulating $Si_xN_yO_z$:H films having different composition ratios which are formed so as to be stacked. In this structure of the lower electrically insulating layer 10, the composition ratio z/y of the electrically insulating film positioned on the side of the emitting layer 5 is preferably smaller than that of the electrically insulating film positioned on the side of the transparent front electrodes 2, namely, the composition ratio z/y of the electrically insulating film positioned on the side of the emitting layer 5 is preferably smaller than one, and that of the electrically insulating film positioned on the side of the transparent front electrodes 2 is preferably larger than one. Then, the thin film type E1 display device can be obtained without deteriorating the characteristics thereof.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A method for fabricating an electroluminescence display device including steps of:

forming at least one transparent front electrode on a transparent substrate;

forming a lower electrically insulating layer on said at least one transparent front electrode;

forming a light emitting layer of an electroluminescent material on said lower electrically insulating layer;

forming an upper electrically insulating layer on said light emitting layer; and forming at least one rear electrode on said upper electrically insulating layer;

wherein at least one of said lower and upper electrically insulating layers is composed of one film of $Si_xN_yO_z$:H, and said one $Si_xN_yO_z$:H film is formed by a plasma chemical vapor deposition method so that the composition ratio z/y of O to N falls within the range from 0.3 to 1.0, the composition ratio x/y of Si to N falls within the range from 0.7 to 1.5, and the hydrogen content is equal to or less than $2\times10^{22}$ atoms/cm$^3$ and wherein said $Si_xN_yO_z$:H film is formed by adjusting a partial pressure ratio of an $N_2O$ gas pressure to a total pressure of an $N_2$—$N_2O$ mixed gas so as to set said composition ratio z/y of O to N, and by adjusting a flow rate ratio of a flow rate of $SiH_4$ gas to a total flow rate of the $SiH_4$ gas and the $N_2$—$H_4$ gas and the $N_2$—$N_2O$ mixed gas so as to set said composition ratio x/y of Si to N.

2. The method as claimed in claim 1, wherein said flow rate ratio of the flow rate of $SiH_4$ gas to the total flow rate of the $SiH_4$ gas and the $N_2$-$N_2O$ mixed gas is set at 2.0%, and said partial pressure ratio of the $N_2O$ gas pressure to the total pressure of the $N_2$-$N_2O$ mixed gas is set so as to be equal to or smaller than 2.0%.

3. An electroluminescence display device comprising:

at least one transparent front electrode;

a lower electrically insulating layer formed on said at least one transparent front electrode;

a light emitting layer of an electroluminescent material formed on said lower electrically insulating layer;

an upper electrically insulating layer formed on said light emitting layer; and at least one rear electrode formed on said upper electrically insulating layer and which are formed as to be stacked on a transparent substrate;

wherein said lower or upper electrically insulating layer is composed of plural $Si_xN_yO_z$:H films, which are formed to be stacked by a plasma chemical vapor deposition method so that the composition ratio z/y of O to N falls within the range from 0 to 3.0, and the composition ratio x/y of Si to N falls within the range from 0.7 to 3.0.

4. The device as claimed in claim 3, wherein said upper electrically insulating layer is composed of said plural $Si_xN_yO_z$:H films, and said plural $Si_xN_yO_z$:H films are formed so that the composition ratio z/y of one film thereof positioned on the side of said emitting layer is smaller than that of another film thereof positioned on the side of said rear electrode.

5. The device as claimed in claim 2, wherein each of said plural $Si_xN_yO_z$:H films is formed so that the hydrogen content is equal to or smaller than $2\times10^{22}$ atoms/cm$^3$.

6. The device as claimed in claim 3, wherein said lower electrically insulating layer is composed of said plural $Si_xN_yO_z$:H films, and said plural $Si_xN_yO_z$:H films are formed so that the composition ratio z/y of one film thereof positioned on the side of said emitting layer is smaller than that of another film thereof positioned on the side of said transparent front electrode.

7. The device as claimed in claim 3, wherein each of said plural $Si_xN_yO_z$:H films is formed so that the hydrogen content is equal to or smaller than $2\times10^{22}$ atoms/cm$^3$.

8. The device as claimed in claim 3 wherein each of said plural $Si_xN_yO_z$:H films is formed so that the hydrogen content is equal to or smaller than $2\times10^{22}$ atoms/cm$^3$.

9. A method for fabricating an electroluminescence display device including steps of:

forming at least one transparent front electrode on a transparent substrate;

forming a lower electrically insulating layer on said at least one transparent front electrode;

forming a light emitting layer of an electroluminescent material on said lower electrically insulating layer;

forming an upper electrically insulating layer on said emitting layer; and forming at least one rear electrode on said upper electrically insulating layer;

wherein at least one of said lower and upper electrically insulating layers is composed of plural $Si_xN_yO_z$:H films, and said plural $Si_xN_yO_z$:H films are formed to be stacked by a plasma chemical vapor deposition method so that the composition ratio z/y of O to N falls within the range from 0 to 3.0, the composition ratio x/y of Si to N falls within the range from 0.7 to 3.0, and the hydrogen content is equal to or smaller than $2\times10^{22}$ atoms/cm$^3$.

10. The method as claimed in claim 9, wherein said upper electrically insulating layer is composed of said plural $Si_xN_yO_z$:H films, and said plural $Si_xN_yO_z$:H films are formed so that the composition ratio z/y of one film thereof positioned on the side of said emitting layer is smaller than that of another film thereof positioned on the side of said rear electrode.

11. The method as claimed in claim 9, wherein said lower electrically insulating layer is composed of said plural $Si_xN_yO_z$:H films, and said plural $Si_xN_yO_z$:H films are formed so that the composition ratio z/y of one film thereof positioned on the side of said emitting layer is smaller than that of another film thereof positioned on the side of said front electrode.

* * * * *